US010309755B1

(12) United States Patent
Bradbury

(10) Patent No.: US 10,309,755 B1
(45) Date of Patent: Jun. 4, 2019

(54) SPIN STABILIZED PROJECTILE FOR SMOOTHBORE BARRELS

(71) Applicant: Michael Sean Bradbury, Eagle, CO (US)

(72) Inventor: Michael Sean Bradbury, Eagle, CO (US)

(73) Assignee: Michael Sean Bradbury

( * ) Notice: Subject to any disclaimer, the term of this patent is extended or adjusted under 35 U.S.C. 154(b) by 0 days.

(21) Appl. No.: 15/993,346

(22) Filed: May 30, 2018

(51) Int. Cl.
*F42B 19/18* (2006.01)
*F42B 10/28* (2006.01)
*F42B 14/06* (2006.01)

(52) U.S. Cl.
CPC ..... *F42B 10/28* (2013.01); *F42B 14/06* (2013.01); *F42B 19/18* (2013.01)

(58) Field of Classification Search
CPC ..... F42B 19/18; F42B 14/067; F42B 10/28; F42B 14/06
See application file for complete search history.

(56) References Cited

U.S. PATENT DOCUMENTS 948,148 A 2/1910 Shenk
1,099,784 A 6/1914 Bizas
1,136,480 A 4/1915 O'Rawe
1,139,916 A 5/1915 Stoehr
1,144,818 A 6/1915 Damer
1,204,950 A 11/1916 Damer
1,205,715 A 11/1916 Crane
1,225,497 A 5/1917 Rodzikevitch
1,152,668 A 9/1917 Sullivan
1,318,858 A 12/1919 Frick
1,330,291 A 2/1920 Witkowski et al.
1,428,683 A * 9/1922 Dougan ..... F42B 10/22 244/3.3
1,464,032 A 8/1923 Daynik
2,014,367 A 9/1935 Breegle
2,661,694 A 5/1950 Allen
3,063,376 A 11/1959 Powell
3,200,751 A 8/1965 Vitt
3,247,795 A 4/1966 Abela
3,330,238 A * 7/1967 Ghougasian ..... B63B 59/00 114/20.1
3,398,682 A 8/1968 Abela
3,893,866 A 7/1975 Hollingsworth
4,063,511 A 12/1977 Bullard
4,161,371 A * 7/1979 Sheppa ..... F03D 3/007 102/208
4,314,510 A * 2/1982 Jeter ..... F42B 14/064 102/521
4,334,657 A 9/1982 Mattson
4,386,747 A 6/1983 Kuhl
4,408,538 A 10/1983 Deffayet et al.
(Continued)

FOREIGN PATENT DOCUMENTS

DE 4134974 A1 * 4/1993 ..... F42B 14/064

*Primary Examiner* — Stephen Johnson

(57) ABSTRACT

The Spin-stabilized Projectile for Smoothbore Barrels would provide for improved accuracy and a flatter trajectory in comparison tot current Foster design projectiles or statically stabilized finned projectiles. The method achieved for spin stabilization here can easily be up-scaled for larger caliber artillery projectiles for when a spin-stabilized projectile is desired from a smoothbore weapon.

1 Claim, 4 Drawing Sheets

(56) References Cited

U.S. PATENT DOCUMENTS

| | | | |
|---|---|---|---|
| 4,644,866 | A | 2/1987 | Sullivan |
| 4,729,320 | A | 3/1988 | Whitten, III |
| 4,976,443 | A | 12/1990 | DeLucia |
| 5,020,438 | A | 6/1991 | Brown |
| 5,066,021 | A | 11/1991 | DeLucia |
| 5,078,407 | A | 1/1992 | Carlston |
| 5,116,224 | A | 5/1992 | Kelsey, Jr. |
| 5,133,261 | A | 7/1992 | Kelsey, Jr. |
| 6,174,252 | B1 | 1/2001 | Mizek |
| 6,217,467 | B1 | 4/2001 | Maleski |
| 6,234,082 | B1 | 5/2001 | Cros et al. |
| 6,240,849 | B1 | 6/2001 | Holler |
| 6,439,127 | B1 | 8/2002 | Cerry |
| 6,571,715 | B1 | 6/2003 | Bennet et al. |
| 6,588,700 | B2 | 7/2003 | Moore et al. |
| 7,178,462 | B2 | 2/2007 | Beasley |
| 8,646,388 | B1 | 2/2014 | Bradbury |
| 9,851,186 | B2 | 12/2017 | Brown |

* cited by examiner

SPIN STABILIZED PROJECTILE FOR SMOOTHBORE BARRELS

CROSS-REFERENCE TO RELATED APPLICATION

This application claims priority to U.S. Provisional Application No. 62/549,980 filed on Aug. 25, 2017.

FEDERALLY SPONSORED RESEARCH

Not Applicable

SEQUENCE LISTING OR PROGRAM

Not Applicable

BACKGROUND OF INVENTION FIELD OF INVENTION

The Spin Stabilized Projectile for Smoothbore Barrels would provide for improved accuracy and a flatter trajectory in comparison to current Foster design or finned projectiles. The method achieved for spin stabilization here can easily be up-scaled for larger caliber artillery projectiles for when a spin-stabilized projectile is desired from a smoothbore weapon.

BACKGROUND OF INVENTION—PRIOR ART

There are many designs and examples of inventions whose goal is to make the most accurate and effective slug or projectile to be fired from a smoothbore firearm. The challenge being traditional slugs have very inefficient aerodynamics and mostly ineffective stabilization techniques. To date there are no projectiles fired from smooth bore firearms that can claim to be accurate and effective up to and past 100 meters. All of these projectiles have either extremely limited trajectories and/or cannot effectively be accurate enough to be able to hit a target to be used for hunting past 50 meters. Below are examples of prior-art for patented projectiles whose goal is for accurate and effective projectiles from smoothbore firearms, all examples have design inadequacies that will be discussed.

U.S. Pat. No. 1,318,858 was issued to John Frick for an expansible projectile for use in firearms and the like. Frick's invention has "outwardly projecting arms or cutting blades which are automatically positioned either due to the force of explosion or by the impact of the projectile against an object." Unfortunately Frick's invention utilizes a complex arrangement to deploy his blades including a plunger. This construction and operation of his expansible projectile make it expensive and too difficult to implement in a practical manner. The plunger style orientation for deploying the blades is also not reliable, as any variation of impact may not activate the plunger correctly. Frick's projectile also does not utilize a sabot to protect his blade while traveling the length of the firearm barrel thus allowing for destabilizing forces to disrupt the intended trajectory.

U.S. Pat. No. 2,661,694 was issued to James Allen and William Cantrell for the Spreader Panel Bullet that "spread laterally upon impact with an object". As with Frick's invention the Spreader Panel Bullet does not incorporate a sabot to encase the projectile thus necessitating the blades and its supporting mechanisms to be encase within the projectile. This configuration is too complicated and expensive for the projectile to be except in specialty situations.

The blades also are not connected to the projectile and only deploy in a forward swept position thus severely hindering its damaging potential, as this design would quickly slow the projectile as it enters the target medium. The blades would be subject to ejection from the projectile causing unpredictable performance. The supporting mechanisms for deploying the blades are complicated and therefore would be expensive and difficult to implement.

U.S. Pat. No. 3,063,376 issued to E. B. Powell in 1959 for Slug for Shotgun is for a slug with a spin imparted to the projectile for stability and accuracy improvement over non-spinning slugs. An object of Powell's invention was "to provide an improved shotgun shell designed to fire a shotgun slug and impart to the slug a rotary or spinning motion. Unfortunately Powell's slug can only have a spin produced onto while exiting the barrel giving the propellant a very brief chance of being effective as was intended. Powell also states "During the movement of the projectile through the smooth bore gun barrel, due to the fact that the gases are confined and cannot exist through openings 15, no rotary motion is imparted to the projectile". Powell's projectile will be subjected to a position adjusting force, the induced spin via propellant gasses, when his projectile is no longer contained by an aligning mechanism, the gun barrel. The projectile would most likely inherit a yaw away from the intended trajectory due to non-uniform appliance of force onto the projectile through an unpredictable ambient medium, the air, causing the intended effect to not be the actual result, which was inaccuracy.

U.S. Pat. No. 3,200,751 issued to G. N Vitt in 1965 for his Aerodynamic Shotgun Slug. His Slug is specified to utilize aerodynamic forces during its flight to produce a rapid rotation for true gyroscopic stabilization. Vitt's projectile unfortunately does not have a spin imparted onto it until it has exited the barrel, when it depends on his helical ribs encountering the ambient air. Vinn states "The only feasible means of inducing rotation of the slug fired from a smooth bore gun is by the dynamic action of the air upon airfoil surfaces . . . " This type of stabilization is entirely reliant on a friction or braking force being applied to the projectile in order to impart a spin, greatly shortening its range.

U.S. Pat. Nos. 3,247,795, and 3,398,682, were both issued to M. F. Abela in 1964 for the Spinning Projectile for Smooth Bore Guns. Abela's projectile utilizes "gaseous decomposition products" to traverse his wad and enter into an inner chamber of the projectile where the products flow through "chambers" in the projectile and exit as "high energy jets to the interior of the barrel" though "gas expulsion orifices". The result according to Abela is to "apply a torque and impart a spin or rotation to the projectile about tis longitudinal axis that continues even after the projectile leaves the barrel muzzle". Abela's projectile unfortunately relies upon a design that must accommodate both the function of a projectile as well as an intricate channeling system to vent propulsion gasses towards the fore end of the projectile and direct them into a tangential force to create a spin onto the projectile. This design would be unnecessarily complex and would be difficult to manufacture and cost prohibitive to gain market acceptance.

Abela also incorporates the use of "axially spaced circular ridges to prevent blow-by of the high pressure gaseous decomposition from the propellant charge. It is unclear why Abela's wad is not sufficient to contain the gases as with most wadded slugs, but what is clear is Abela's ridges moves the center of pressure rearward from the center of gravity due to increased air resistance. Also Abela's projectiles "body portion" is a separate part affixed to a "nose portion"

which is the ballistic or bullet portion, both of which remain attached as an assembly throughout its trajectory to impact. The ridges and body portions of the Abela's projectile would decrease the penetrability of the projectile by increasing resistance from interference of the target material impacting the ridges and body portion.

U.S. Pat. No. 4,063,511 was issued to James Bullard for the Spinning Shot Gun Projectile. Bullard's invention specifies a spinning shot gun projectile comprising a cylindrical body having radially projecting vanes arranged with respect to the longitudinal axis of the body at an angle predetermined for air impingement during flight. Unfortunately Bullard's design was not as effective as intended to impose a spin onto the projectile that would improve stability. Also Bullard's design relies on direct air impingement for rotation thus his projectile is only intended to spin after leaving the barrel.

U.S. Pat. No. 4,334,657 issued to Kjell Mattson in 1982 for a Device for Fin-Stabilized Shell or the like. The projectile in general is a same for caliber cargo artillery shell for delivering an explosive charge. The projectile is tapered in design so as to have extensible fins that are retracted when in the barrel and deploy upon flight for a same for cannon barrel caliber diameter. Mattson's projectile does not rely upon sabots or wads during the firing phase imposing upon the projectile an inefficient aerodynamic profile. The fins are also individually attached to the projectile body and are not releasable upon entry as the projectile is meant to completely fracture upon charge detonation.

U.S. Pat. No. 4,408,538 was issued in 1983 issued to Jean Deffayet et al. for a Launching Mechanism for a Sub-caliber Projectile. Unfortunately Deffayet's Launching mechanism is for only the Launching Mechanism and not for the projectile or armor piercing arrow as is described. Deffayet's invention is for a sabot type of carrier that affixes it and transmits propelling force directly onto the projectile body via threads or grooves in both the sabot parts and projectile body. The mechanism is reliant upon an annular band for keeping the mechanism and projectile in a uniform arrangement until exiting the barrel and a sealing disk for retaining propellant gas.

U.S. Pat. No. 4,644,866 was issued to Leroy Sullivan in 1987 for an ammunition round that is a full caliber round that utilized a sabot to engage full length grooves in the projectile body. Sullivan's patent is for use in a rifled and smooth bore barreled firearm allowing for the projectile both rotational and non-rotational flight. Sullivan's smooth bore projectile here also utilized full length grooves for engagement onto the sabot decreasing the mass of the projectile while increasing cost and complexity of the bullet as well and has no stabilizing means such as a fin portion of the projectile to bias the center of pressure rearward the center of gravity for the projectile.

U.S. Pat. No. 5,078,407 was issued to Marvin Carlston for his Expandable Blade, Composite Plastic, and Broadhead Hunting Arrow Tip. Carlston here describes the use of "rotatable blades which are trunnion mounted securely in the body of the tip, and which are designed to be partially exposed while in flight". Carlston describes the function of the blades as being able to "rotate into an expanded position upon impact" and "the blades are mounted in a forward position with the tips of the blades protruding outside of the tip body". Carlston's design is one of simplicity and functionality and has been proven successful in the marketplace. Carlston's invention however is designed for bow hunting and is not for use with firearms, therefore it does not have any relevance to the present invention.

U.S. Pat. No. 6,234,082 issued to Cros et al. in 2001 for a Large-Caliber Long-Range Field Artillery Projectile. Cros discloses a projectile to be able to be stabilized by a means of a tail piece placed at the rear of part of the body and which is deployed upon exiting the gun barrel. Cros also disclosed "To stabilize the projectile on its trajectory, either spin stabilization or fin-stabilization is used". Cros further discloses "Sliding band 10 . . . is intended to mesh with the rifling in a gun barrel and to slide on thrusting part 9 so as to reduce the spin rate of the projectile. Thus, upon exiting the gun barrel, the projectile is only subjected to a low spin rate of around 10 revs/sec".

The applicant's projectile has disclosed to be only used with a smoothbore barrel so as to not subject the sabot and projectile to spin stabilizing rifling. The applicant's projectile has no mechanism to reduce the spin induced by the rifling that would in effect cause the applicants projectile to be neither stable in flight nor accurate in trajectory termination.

U.S. Pat. No. 6,240,849 was awarded to Christopher Holler for the Projectile with Expanding Members. Holler's invention has "open-biased arm members" that are "compressed into a restrained position" before firing the bullet. When the bullet is fired "the arms extend to the unrestrained position" which then catch the target material and slow the projectile down. Holler's invention is for a projectile suited for use in a rifled barrel and not a smooth bore shotgun as it relies upon centrifugal force for stabilization. Also his arms extend when the projectile is fired and not upon impact thus creating a massive amount of drag upon the projectile thus making it grossly inefficient as a projectile. Holler's projectile unfortunately may not be a feasible working projectile as it has many lacking characteristics that prevent it from becoming a workable firearm projectile.

U.S. Pat. No. 7,178,462 was awarded to Beasley for the Projectile with Members that Deploy Upon Impact. Beasley's projectile relies upon a "nose piece that shears off upon impact with the target, causing the nose piece to be pushed inside the projectile" and "nose piece pushes on members that deploy outwardly and lock into place, thereby greatly increasing the damage done to the target". Beasley's invention, much like Holler's, is a projectile intended for use within a rifled barrel and not a smoothbore barrel as it relies upon centrifugal force for stabilization of the projectile. Beasley's members or blades reside inside of the projectile and require an intricate mechanical arrangement for the deployment of the blades. Also the members or blades are unfortunately restricted in size due to the stowing of the blades within the bullet thus the members are also severely restricted in the amount of damage the can inflict upon the target. In all Beasley's projectile is complicated in use and construction and offers minimal advantage for the members to inflict damage therefore the concept has minimal value for its intended purpose.

OBJECTS AND ADVANTAGES

The advantages of the Spin-stabilized Projectile for Smoothbore Barrels are as follows:

- To produce a sub-caliber spin-stabilized projectile for use with smoothbore barreled weapons
- To produce a sub-caliber spin-stabilized projectile that does not rely on static stabilizers like fins for stabilization.
- To produce a spinning projectile that does not rely on barrel rifling, canted fins impingement on air-flow, or rockets to spin the projectile.

To provide a spinning projectile prior to and during flight after firing.

To provide a projectile with an improved aerodynamic shape superior in performance to Foster slugs or fin stabilized projectiles.

To create a spin-stabilized projectile that can easily be up scaled to larger caliber projectiles such as artillery or the like.

To provide for a spin-stabilized projectile for smoothbore barrels for as an improvement in performance over statically stabilized finned projectiles.

ABSTRACT

The Spin Stabilized Projectile for Smoothbore Barrels would provide for improved accuracy and a flatter trajectory in comparison to current Foster design or fin stabilized projectiles. The method achieved for spin stabilization here can easily be up-scaled for larger caliber artillery projectiles for when a spin-stabilized projectile is desired from a smoothbore weapon.

ILLUSTRATIONS

REFERENCE NUMERALS

Figure 1:
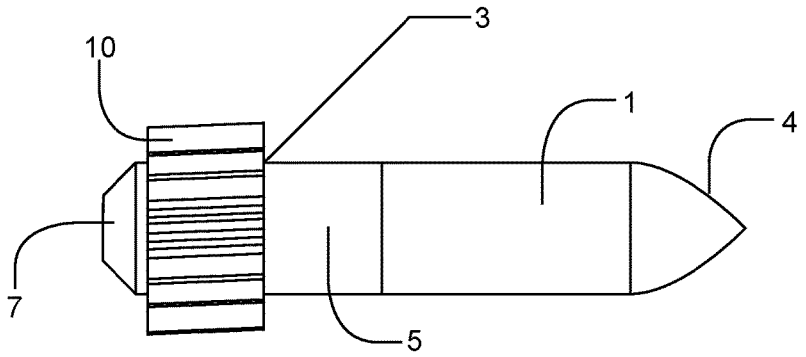
FIG. 1 is a side view of the Spin-stabilized projectile and turbine assembly.
Figure 2:
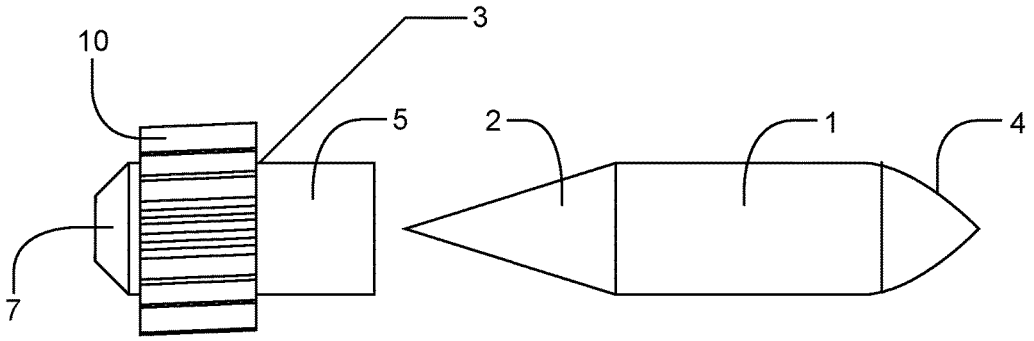
FIG. 2 is a side view of the Spin-stabilized projectile and turbine separated.
Figure 3:
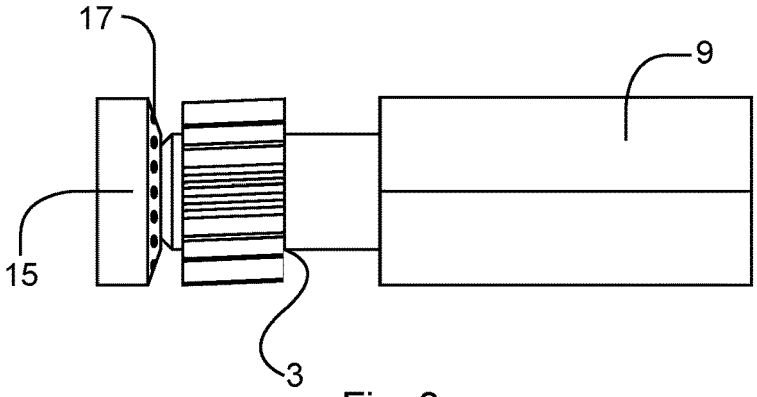
FIG. 3 is a side view of a SSP cartridge assembly, with sabots, and a gas seal.
Figure 4:
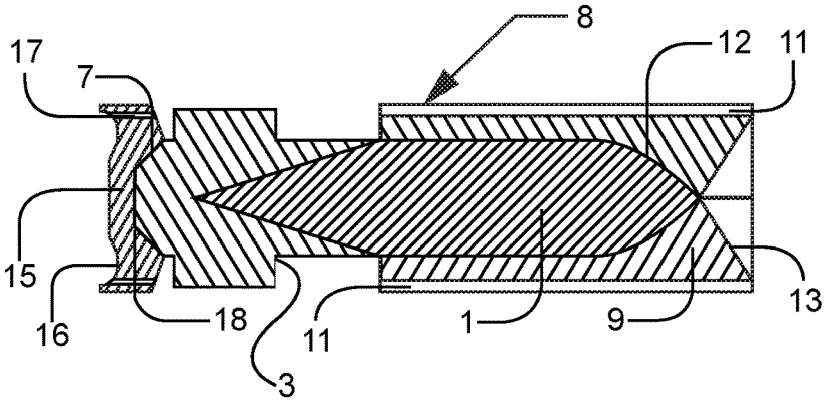
FIG. 4 is a sectional view from FIG. 3.
Figure 5:
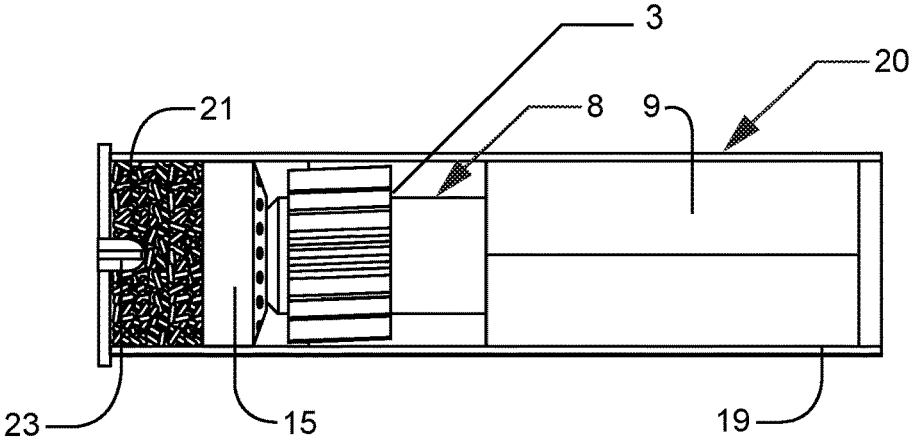
FIG. 5 is a sectional view of a SSP cartridge assembly loaded into a cartridge.
Figure 6:
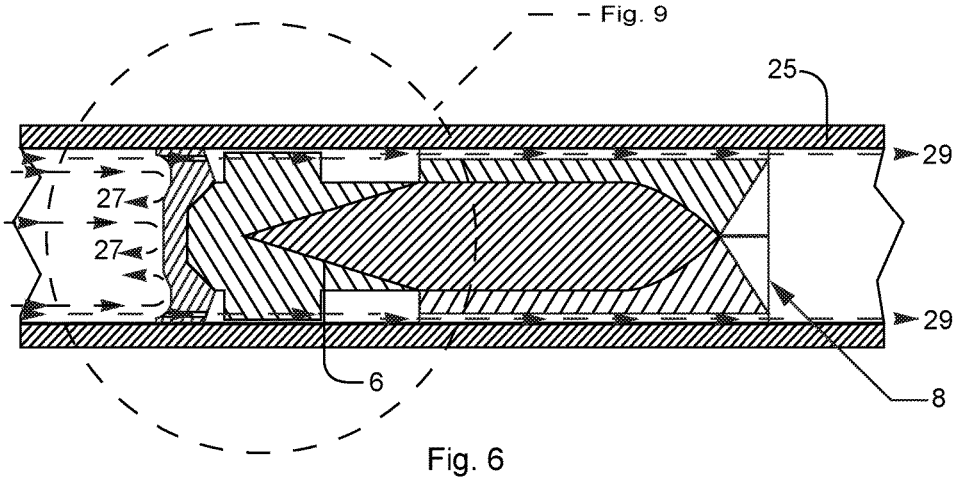
FIG. 6 is a sectional view of a Spin-stabilized projectile, sabots, and gas seal in a smoothbore barrel during firing.
Figure 7:
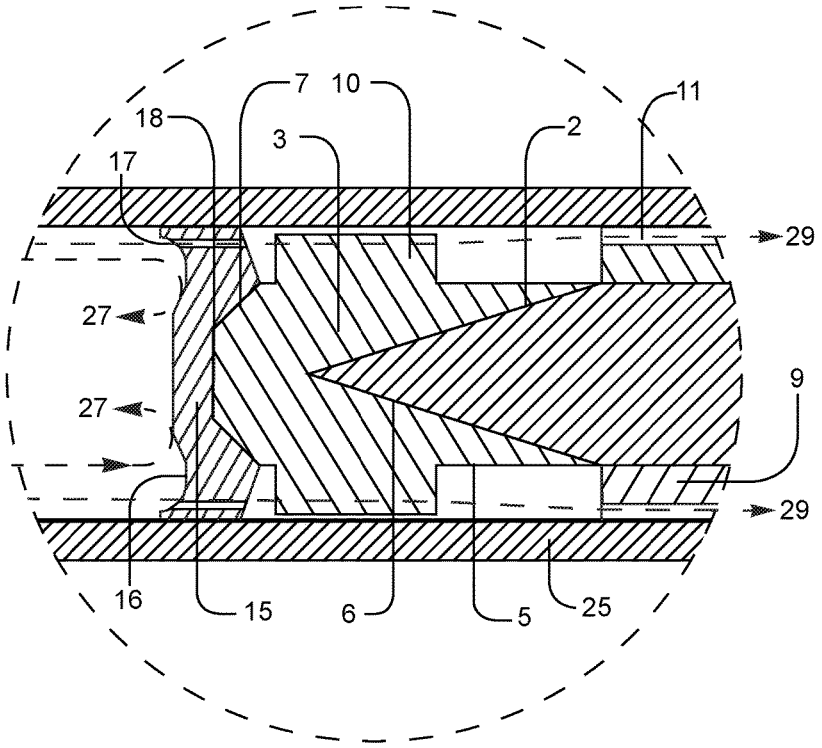
FIG. 7 is an enlargement from FIG. 6.
Figure 8:
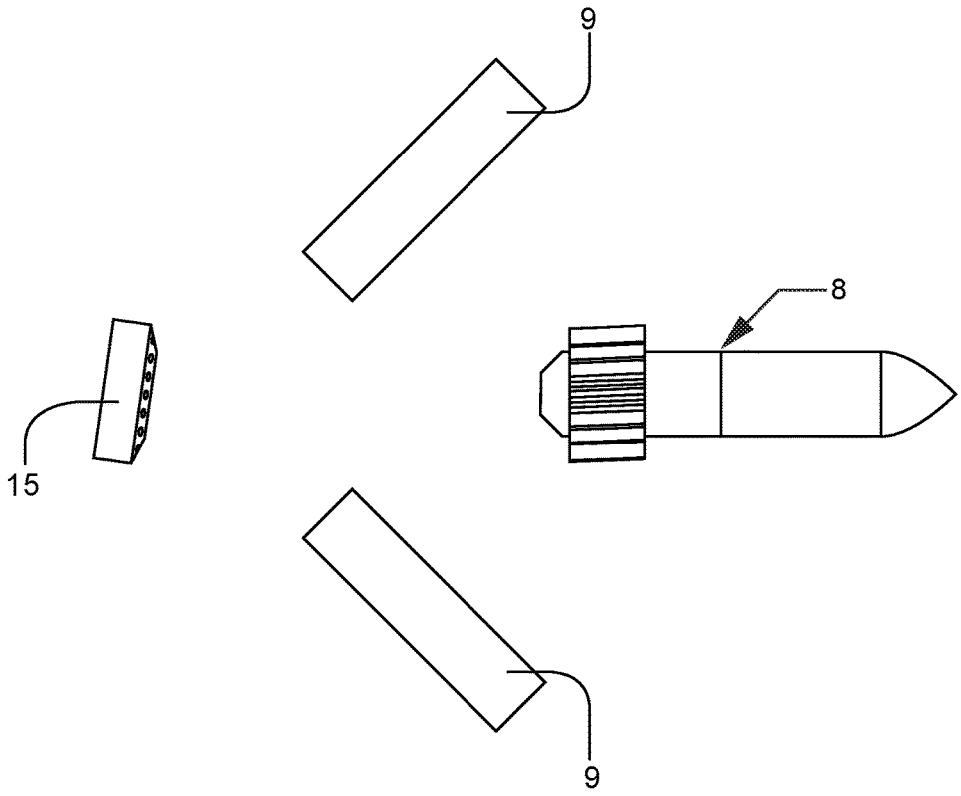
FIG. 8 is a view of a Spin-stabilized projectile, sabots, and gas seal exiting barrel.
Figure 9:
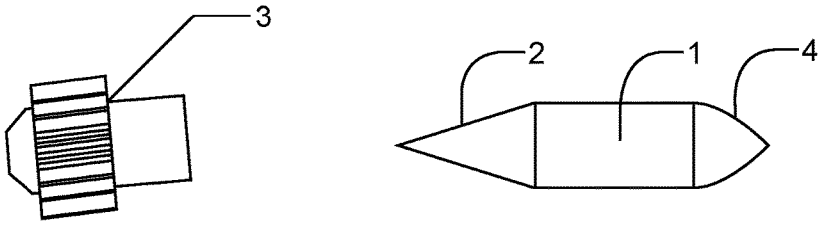
FIG. 9 is a view of the Spin-stabilized projectile in flight, the turbine ejecting from projectile.

1. Spin-stabilized projectile
2. Projectile aft-end
3. Turbine
4. Projectile fore-end
5. Turbine sleeve
6. Turbine clutch
7. Turbine bearing
8. SSP cartridge assembly
9. Sabot leaf
10. Turbine blade
11. Sabot gas port
12. Sabot projectile retainer
13. Sabot wind scoop
15. Gas seal
16. Gas seal aft end
17. Gas seal gas port
18. Gas seal bearing
19. Shell hull
20. SSP cartridge
21. Propellant
23. Primer
25. Gun barrel
27. Gas pressure
29. Gas jet Description: Spin-Stabilized Projectile FIGS. 1-9

FIGS. 1-9 shows the Spin-stabilized projectile, SSP cartridge assembly, a loaded SSP cartridge, and the Spin-stabilized projectile in flight. A SSP (Spin-stabilized Projectile) assembly (8) consists of a Projectile (1), Turbine (3), Gas seal 15, and Sabot leaf (9).

A Projectile (1) has a Projectile aft-end (2) and a Projectile fore-end (4), and a sufficiently uniform distribution of mass extending radially from its longitudinal axis where said Projectile (1) is capable of spin stabilization. The Projectile (1) has a Projectile aft-end (2) mated to a Turbine clutch (6). Turbine (3) has a Turbine sleeve (5), Turbine clutch (6), and a Turbine bearing (7), the Bearing (7) is mated to a Gas seal bearing (18). The Gas seal (15) having at least one Gas seal gas port (17) and a Gas seal bearing (18). Gas seal gas port (17) has an opening at the aft end and fore end of the Gas seal (15) creating a channel.

Each SSP assembly (8) has multiple Sabot leaves (9), each of which has at least one Sabot gas port (11), Sabot projectile retainer (12), and a Sabot wind scoop (13). Sabot gas port (11) has an opening at the aft end and fore end of the Sabot leaf (9) creating a channel. Sabot leaves (9) encases and supports the Projectile (1) while Spin-stabilized cartridge assembly (8) is loaded into the Shell hull (19) prior to firing and also during firing when in the Gun barrel (25).

Operation: Spin-Stabilized Projectile FIGS. 1-9

A SSP assembly (8) is loaded into a shell containing in arrangement for firing Propellant (21), Primer (23) and Shell hull (19). As the shell is fired the SSP cartridge assembly (8) is forced into the Gun barrel (25) by the Gas pressure (27) from the burning Propellant (21) against the Gas seal aft end (16) of Gas seal (15). Some of Gas pressure (27) is vented through Gas seal ports (17) and emerge as Gas jets (29) that are directed by Ports (17) onto Turbine blades (10) of the aft-end portion of the Turbine (3). The Gas jets (29) imposes a forward force onto the Turbine blades (10) that converts the Gas jets (29) into rotational energy onto the Turbine (3) that rotates around its horizontal axis. The Gas jets (29) are then vented through the Sabot gas ports (11) of Sabot leafs (9) and into the ambient air foreword of the Spin-stabilized cartridge assembly (8).

The Turbine clutch (6) portion of the Turbine (3) is mated to the Projectile aft-end (2) and in turn transfers rotational force from Turbine (3) onto the Projectile (1). As a result the Projectile (1) rotates inside of Sabot leaves (9) as the SSP cartridge assembly (8) is forced through the Gun barrel (25). The Sabot leaves (9) contain and align the Projectile (1) along the central axis of the firearm barrel, the greater diameter of Sabot (9) substantially filling the void created by the Projectile (1) being sub caliber.

As the SSP cartridge assembly (8) exits the end of the Gun barrel (25) Sabot wind scoops (13) encounter ambient air which provides a resistance that is converted by Scoops (13) into a force perpendicular to the trajectory of the Projectile (1) where all Leaves (9) eject simultaneously so as to not create any errant forces affecting the trajectory of Projectile (1).

Once the Sabot leaves (9) have been ejected from the Projectile (1) the fore end portion of the Turbine blades (10) now encounter the ambient air creating a resistance onto the Blades (10) which forces the Turbine (3) rearward from Projectile (1). The Turbine blades will all be canted angularly and uniformly against the flow of ambient air thus imposing a force rearward onto Turbine (3) causing Turbine clutch (6) to disengage Projectile aft-end (2) causing Turbine (3) to eject rearward and away from Projectile (1) as it continues on its trajectory.

The Spin-stabilized Projectile for Smoothbore Barrels relies on spin-stabilization to allow the projectile to be more effective at longer distances and improved accuracy at those longer distances than current statically stabilized projectiles relying on fins, and will have a much more aerodynamic efficient shape compared to finned projectiles as well.

The Spin-stabilized Projectile for Smoothbore Barrels will also have twice the range of, and improved accuracy over current Foster style slugs, which rely only on a weighted fore-end combined with a lighter cylindrical aft-end.

The invention claimed is:

1. An Assembly for a sub-caliber rotationally stabilized projectile for use in a smoothbore barrel firearm comprising:

a. a projectile having a fore-end portion, an aft-end portion, and a sufficiently uniform distribution of mass extending radially from its longitudinal axis whereby said projectile is capable of spin stabilization; and b. a turbine having a turbine clutch, a turbine bearing, and at least one turbine blade, said turbine clutch can be mated to said aft-end portion of said projectile; and c. a gas seal having a gas seal bearing, and at least one gas seal port, said gas seal bearing can be mated to said turbine bearing whereby said turbine bearing is supported by and is and rotationally independent of said gas seal bearing, said gas port converts burning propellant into a gas jet imposing a force onto said turbine blade; and d. said turbine blade converts said gas jet force into a rotational force causing said turbine to rotate whereby said turbine imposes a rotational force onto said projectile whereby both said turbine and said projectile rotate while being supported by said gas seal and sabots; and e. at least one said sabot each having an inner surface that can be mated with and is rotationally independent from said projectile fore-end portion, each of said sabot has at least one sabot gas port whereby said gas jet is vented through said sabot and forward of said assembly, said sabots, said turbine, and said gas seal are eject-able from said projectile when said projectile exits said barrel.

* * * * *